US008432351B2

(12) United States Patent
Pan et al.

(10) Patent No.: US 8,432,351 B2
(45) Date of Patent: Apr. 30, 2013

(54) DRIVING SYSTEM FOR MATRIX TYPE BACKLIGHT MODULE

(75) Inventors: Ching-Yuan Pan, Hsinchu (TW); Yen-Hsun Kuo, Hsinchu (TW); Po-Sheng Wu, Hsinchu (TW)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 833 days.

(21) Appl. No.: 11/559,569

(22) Filed: Nov. 14, 2006

(65) Prior Publication Data

US 2007/0132708 A1 Jun. 14, 2007

(30) Foreign Application Priority Data

Dec. 12, 2005 (TW) ..... 94143947 A

(51) Int. Cl.
*G09G 3/36* (2006.01)

(52) U.S. Cl.
USPC ..... 345/102; 345/98

(58) Field of Classification Search ..... None
See application file for complete search history.

(56) References Cited

U.S. PATENT DOCUMENTS

| | | | | |
|---|---|---|---|---|
| 7,394,448 | B2 * | 7/2008 | Park et al. | 345/102 |
| 2002/0159002 | A1 * | 10/2002 | Chang | 349/61 |
| 2005/0104839 | A1 * | 5/2005 | Baik | 345/102 |
| 2006/0114218 | A1 * | 6/2006 | Ho et al. | 345/102 |

* cited by examiner

*Primary Examiner* — Sumati Lefkowitz
*Assistant Examiner* — Duane N Taylor, Jr.
(74) *Attorney, Agent, or Firm* — Cheng-Ju Chiang

(57) ABSTRACT

A driving system for a matrix type backlight module having a plurality of light spots is provided. The driving system includes a timing controller providing a timing signal to control a starting up sequence and a turning on time for each of the plurality of light spots, a row driver electrically connected to the timing controller and providing a turning on time of the matrix type backlight module in a row direction according to the timing signal, and a column driver electrically connected to the timing controller and providing a turning on time of the matrix type backlight module in a column direction according to the timing signal.

18 Claims, 16 Drawing Sheets

DRIVING SYSTEM FOR MATRIX TYPE BACKLIGHT MODULE

FIELD OF THE INVENTION

The present invention relates to a driving system for a backlight module, and more particularly to a driving system for a matrix type backlight module.

BACKGROUND OF THE INVENTION

With the continuous improvement of the manufacturing technique for the liquid crystal display (LCD), the large-scale mass production technique is gradually maturing, so that the LCD related product with cost advantage after the large-scale mass production is gradually advanced from the personal computer related field to the family electrical appliance and other consumer electronic fields. In recent years, many developed countries announce in succession the approaching of digital information era. In the process of gradually phasing out the analog system, an upsurge of substituting the traditional cathode ray tube (CRT) television with the liquid crystal television is gradually forming.

In spite of the fact that compared to the traditional CRT television the liquid crystal television features a high resolution and a low energy consumption and is extremely light and thin, its development for dynamic image and color is far inferior than that of the CRT television. Therefore, in the process of expanding the liquid crystal television market, how to overcome the above-mentioned development disadvantage is one of the key factors for influencing whether the liquid crystal television could extensively substitute the traditional CRT television.

In the present liquid crystal display technique, the backlight module design is a key factor for influencing the development quality of the liquid crystal display device. Since the liquid crystal material itself is a non-self illuminating material, a backlight board must be provided as the light source for the LCD. FIG. 1 is a schematic diagram showing the structure of a backlight module in the prior art. As shown in FIG. 1, the backlight module 100' mainly comprises a cold cathode fluorescent lamp 10', a light guide panel 20', and a plurality of optical thin films 30', 40' etc. The cold cathode fluorescent lamp 10' is a linear light source for guiding the light to the direction of the light guide panel 20' through the surrounding reflecting plate 12'. The light guide panel 20' is a clapboard whose bottom is designed as a tilted surface and coated with a refractive layer 22' so as to convert the light emitted by the cold cathode fluorescent lamp 10' into a planar light source and project it upwardly. To average the light source projected by the light guide panel 20', the top of the light guide panel 20' comprises a plurality of optical thin films 30', 40' to average or enhance the planar light formed. Therefore, the backlight module 100' of the traditional liquid crystal display device converts the linear light source into the planar light source through the design of layers of the optical plate or optical thin film. However, the entire light energy utilization rate is lost a great deal after the light reflects and penetrates several layers. Most of the entire light energy utilization rate will be lost when the light passes through the polarizing plate and color filter of the liquid crystal panel, resulting in the chromatic degree of saturation and brightness of the liquid crystal display device significantly inferior than those of the traditional CRT display device.

In spite of the fact that in the past the requirement for the color and brightness of the liquid crystal display were not obvious in the application of the personal computer (e.g., the personal computer monitor and the laptop computer monitor), the requirement for the color and brightness is draconian when entering the liquid crystal television application field. Therefore, the applicant submitted a patent application (application Ser. No. 11/458,761) related to a "liquid crystal display device" of the matrix type backlight module on Jul. 20, 2006 after scrupulous study and steady effort. The present application continues the conception of the previous application to propose a "driving system for the matrix type backlight module". It is hoped that the combination of the techniques of the two applications will provide a matrix type backlight module that has high brightness and is able to be adjusted rapidly and independently, thereby providing better display performance for the liquid crystal display device and effectively overcoming the flaws in the color and brightness of the current liquid crystal television.

SUMMARY OF THE INVENTION

In accordance with one aspect of the present invention, a driving system for a matrix type backlight module having a plurality of light spots is provided. The driving system includes a timing controller providing a timing signal to control a starting up sequence and a turning on time for each of the plurality of light spots, a row driver electrically connected to the timing controller and providing a turning on time of the matrix type backlight module in a row direction according to the timing signal, and a column driver electrically connected to the timing controller and providing a turning on time of the matrix type backlight module in a column direction according to the timing signal.

In accordance with a further aspect of the present invention, a blinking backlight module is provided. The blinking backlight module includes a matrix type backlight source, comprising plural independent illuminating units to form plural light spots of the blinking backlight module; and a driving system controlling a starting up sequence and a turning on time of each of the plural light spots of the blinking backlight module.

Preferably, the driving system further includes a timing controller providing a timing signal to control a starting up sequence and a turning on time of each of the plurality of light spots; a row driver electrically connected with the timing controller and providing a turning on time of the matrix type backlight source in a row direction according to the timing signal; and a column driver electrically connected to the timing controller and providing a turning on time of the matrix type backlight source in a column direction according to the timing signal.

In accordance with further another aspect of the present invention, a driving method of a matrix type backlight module having a plurality of light spots, a row driver and a column driver is provided. The driving method includes the steps of providing a timing signal to control a starting up sequence and a turning on time of each of the plurality of light spots of the matrix type backlight module; transmitting the timing signal to the row driver and the column driver; and determining a respective driving power for each of the plurality of light spots according to the timing signal.

In conclusion, the present invention provides a driving system for a matrix type backlight module. The driving system not only can be operated in coordination with the feature of the matrix type backlight module to achieve rapid driving and independent modulation, but also can modulate a local area independently to achieve blinking backlight modulation so as to increase the quality of the dynamic image. Besides, the driving system in the present invention can also be integrated with the active thin film transistor (TFT) driving system to drive each of the plurality of light spots of the matrix backlight module and the corresponding TFT pixels simultaneously.

The above aspects and advantages of the present invention will become more readily apparent to those ordinarily skilled in the art after reviewing the following detailed descriptions and accompanying drawings, in which:

BRIEF DESCRIPTION OF THE DRAWINGS

FIG. 3(*b*) is a schematic diagram showing the driving system for the matrix type backlight module according to a second embodiment of the present invention.

DETAILED DESCRIPTION OF THE PREFERRED EMBODIMENT

Figure 1:
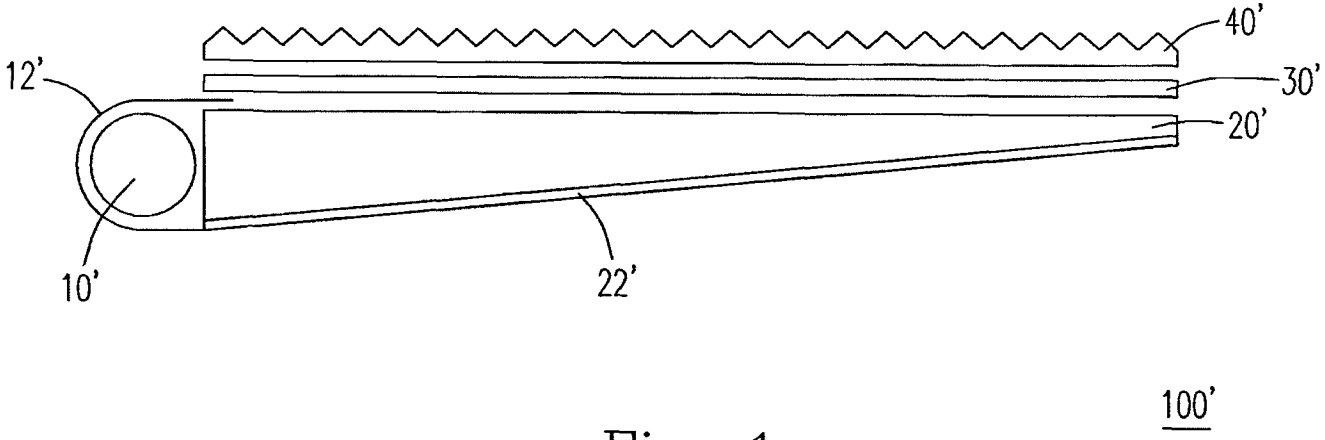
FIG. 1 is a schematic diagram showing the structure of a backlight module in the prior art.
Figure 2:
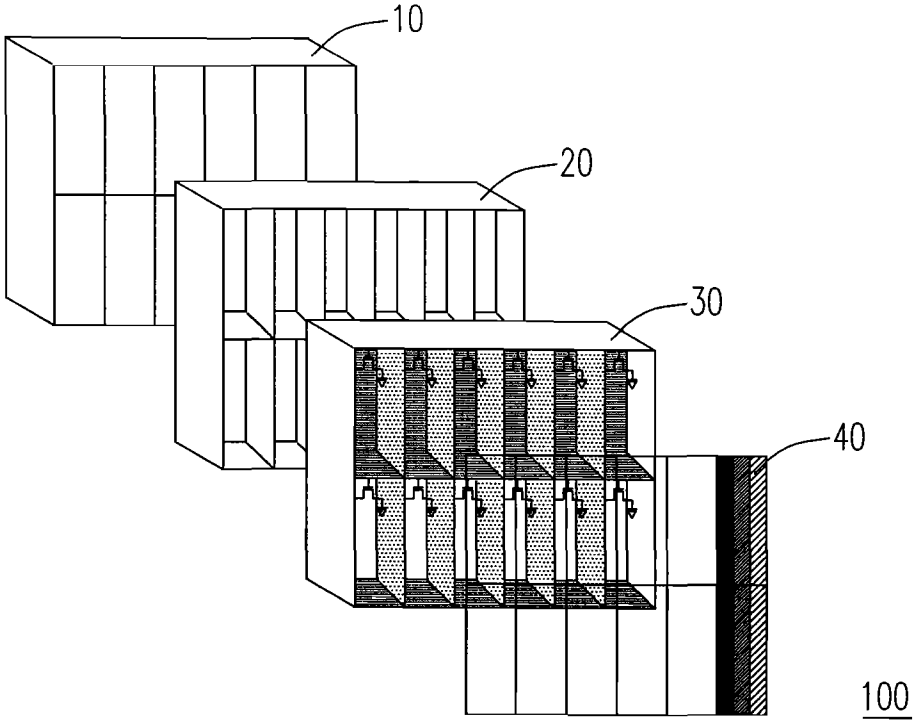
FIG. 2 is a schematic diagram showing the liquid crystal display device cooperating with the matrix type backlight module of the present invention.

Please refer to FIG. 2, which is a schematic diagram showing the liquid crystal display device cooperating with the matrix type backlight module of the present invention. As shown in FIG. 2, the liquid crystal display device 100 comprises a matrix type backlight module 10 for forming a planar light source in which each of the plurality of light spots can be independently modulated. A black matrix layer 20 is disposed on top of the matrix type backlight module 10 to separate the light between the light spots in proximity. A thin film transistor (TFT) layer 30 is disposed on top of the black matrix layer 20 for forming each of the plurality of pixels for the liquid crystal display device. The number of pixels of the thin film transistor layer 30 can be the number of the light spots of the matrix type backlight module or its multiple, in order to make each of the plurality of light spots of the matrix type backlight module 10 corresponding to one or n of the pixels of the thin film transistor layer 30, wherein n is positive integer. Besides, a color filter 40 is disposed on top of the thin film transistor layer 30 to make the liquid crystal display device 100 generate color images.

The above-mentioned liquid crystal display device 100 has already been disclosed in the patent application entitled "liquid crystal display" (application Ser. No. 11/458,761) submitted by the applicant on Jul. 20, 2006. The present application continues to propose a circuit driving system applicable to the matrix type backlight module.

Figure 3A:
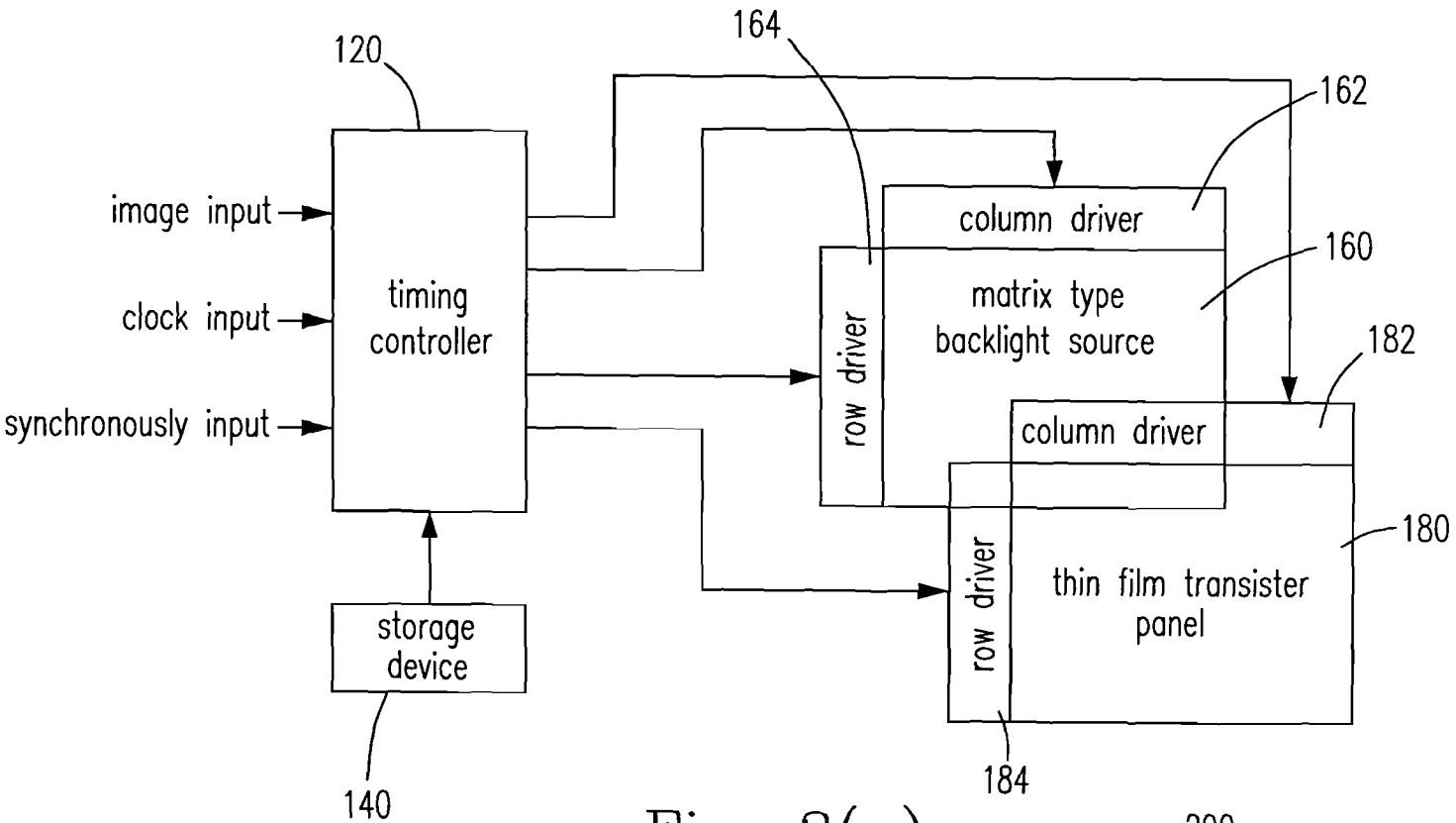
FIG. 3(*a*) is a schematic diagram showing the driving system for the matrix type backlight module according to a first embodiment of the present invention.
Figure 3B:
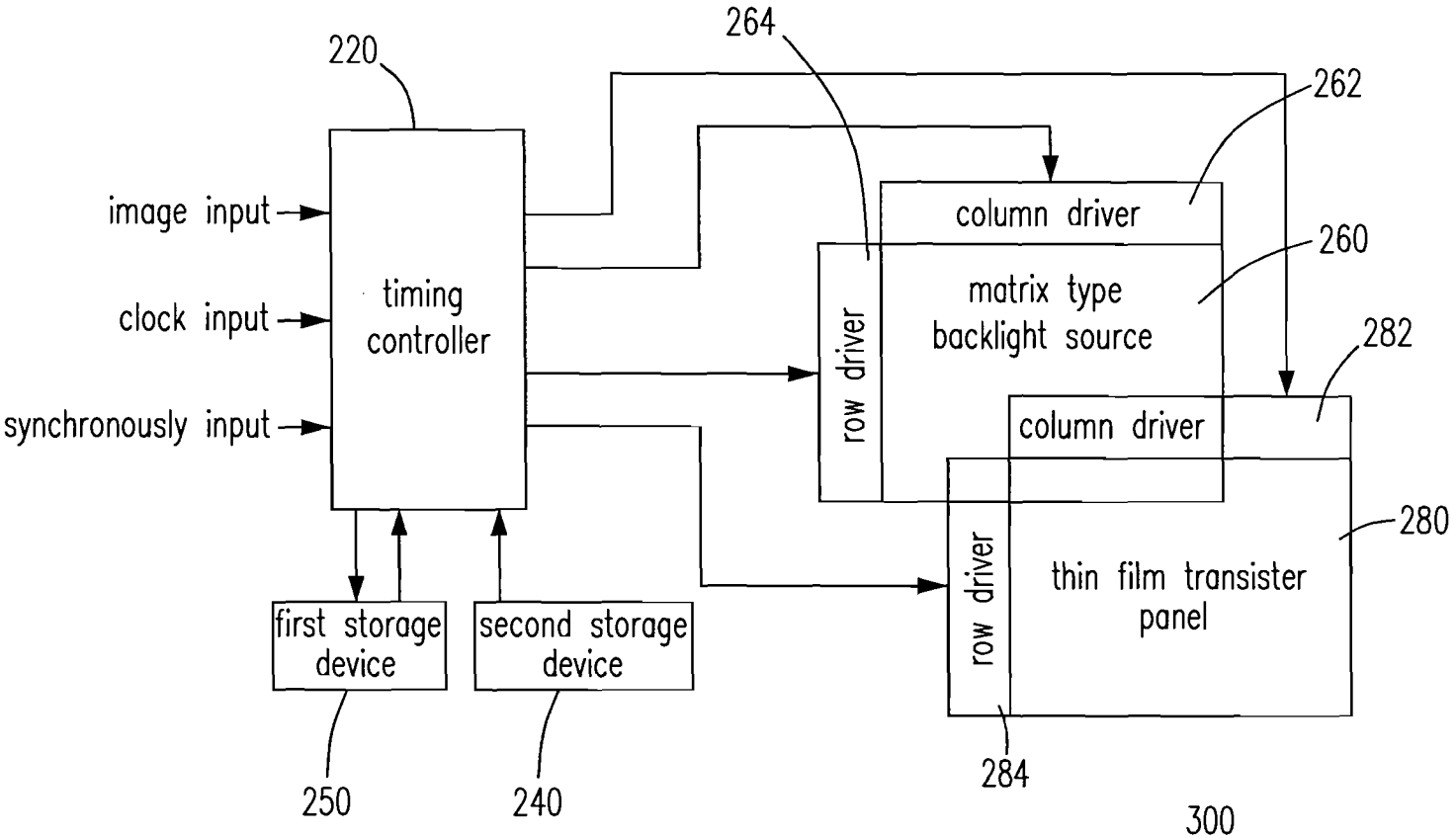

Please refer to FIG. 3(*a*), which is a schematic diagram showing the driving system for the matrix type backlight module according to a first embodiment of the present invention. As shown in FIG. 3(*a*), the driving system 200 at least comprises a timing controller 120, a row driver 164, and a column driver 162. The timing controller 120 is the connecting interface for electrically connecting the external control module (not shown) and the panel driving module (i.e. the row driver 164 and the column driver 162). The external control module mainly inputs the external signals (the image signal, clock signal or synchronous signal) to the timing controller 120 through components like the analog/digital converter, digital image interface, microprocessor, etc. to enable the timing controller 120 to provide a timing signal to control the starting up sequence and turning on time of each of the plurality of light spots for the matrix type backlight source 160. Besides, the row driver 164 and the column driver 162 are disposed on the matrix type backlight source 160. The row driver 164 and the column driver 162 receive the timing signal from the timing controller 120 and control the turning on time and driving sequence of the respective row direction light spots and column direction light spots for the matrix type backlight source 160 according to the timing signal.

In one embodiment, the above-mentioned driving system for the matrix type backlight module further comprises a storage device 140 connected to the timing controller 120. A look up table (LUT) is embedded in the storage device 140. The look up table records the data of the relationship between the driving power and the output brightness of each of the plurality of light spots. According to the data in the look up table, the storage device 140 can provide a power signal to the timing controller 120 to determine the output brightness of each of the plurality of light spots for the matrix type backlight source 160.

Please refer to FIG. 3(*b*), which is a schematic diagram showing the driving system for the matrix type backlight module according to a second embodiment of the present invention. Compared to the above-mentioned first embodiment, the matrix type backlight module driving system 300 roughly includes similar components as the matrix type backlight module driving system 200 in the first embodiment (e.g., the timing controller 220, column driver 262, row driver 264, etc.), and it has substantially the same timing signal generation and controlling methods as the matrix type backlight module driving system 200. However, in the aspect of power signal generation procedure, beside the original storage device 240 (the second storage device in FIG. 3(*b*)), another storage device 250 (the first storage device in FIG. 3(*b*)) is added in the matrix type backlight module driving system 300 of this embodiment. The first storage device 250 is a repeatable access storage device (usually a random access memory (RAM)), which records the driving power data of the plurality of light spots of the matrix type backlight source 260 in the previous frame. The driving power data of the plurality of light spots of the matrix type backlight source 260 in the next frame is determined by that in the previous frame. That is to say, the first storage device 250 provides an initial value for the driving power for the plurality of light spots of the matrix type backlight source to switch the brightness of each light spot more precisely and rapidly. Under this design, the data in the look up table stored in the second storage device record the relationship between the driving power change and output brightness of each light spot during the switching among each frame of the matrix type backlight source.

In the above two embodiments, the driver can be integrated into the driver of the thin film transistor (TFT) panel arranged in matrix (such as the thin film transistor (TFT) panels 180, 280 in FIGS. 3(*a*) and 3(*b*)) to enable the timing signal and power signal provided to the column drivers 162, 262 of the matrix type backligbt sources 160, 260 to be also provided to the column drivers 182, 282 of the TFT panels 180, 280. Similarly, the timing signal and power signal provided to the row drivers 164, 264 of the matrix type backlight source 160, 260 are also provided to the row drivers 184, 284 of the TFT panels 180, 280. Thus, the driving system can be used to synchronously drive the light spots and corresponding TFT pixels of the matrix type backlight source.

Figure 4B:
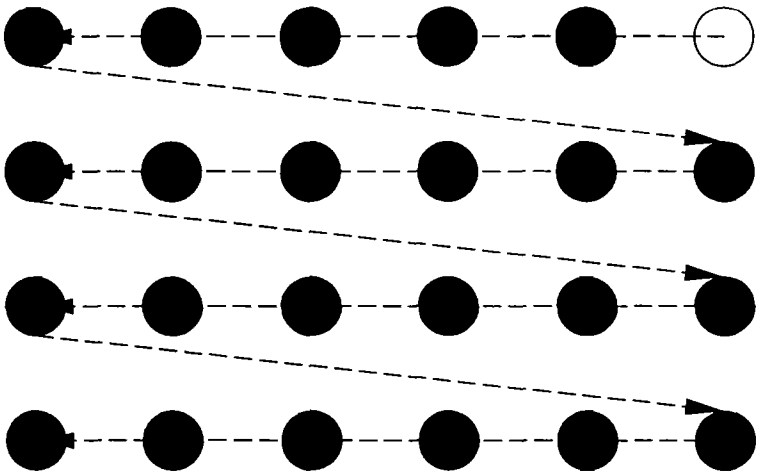
FIGS. 4(*a*)-11(*b*) show the embodiments of the independent driving for each of the plurality of light spots or part of the area of the matrix type backlight module according to the present invention.
Figure 4A:
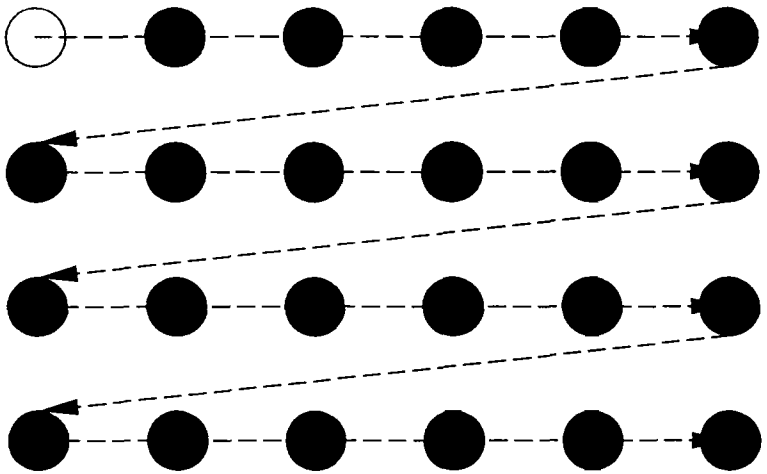

Besides, according to the designs of the above-mentioned first and second embodiments, the matrix type backlight module driving system of the present invention can be combined with a matrix type backlight source to form a blinking backlight module. The configurations of the matrix type backlight source and the driving system are shown in the embodiment of FIG. 3(*a*) or FIG. 3(*b*), in which the backlight source comprises plural independent illumination units. As shown in FIGS. 4(*a*)-11(*b*), the independent illumination units are arranged in matrix, in which the starting up sequence, turning on time and output brightness of each of the plurality of illumination units are controlled by the driving system. As mentioned above, the driving method of the driving system is to provide a timing signal by a timing controller to control the starting up sequence and turning on time of each of the plurality of light spots. Besides, for the row driver and column driver of the matrix type backlight source, the turning on time required by each of the independent illumination units of the matrix type backlight source is determined by the timing signal transmitted by the timing controller. In one embodiment, the above-mentioned driving system further comprises a storage device for providing a driving power signal to the timing controller to achieve the purpose of precisely controlling the driving power change of each independent illumination unit.

Figure 5B:
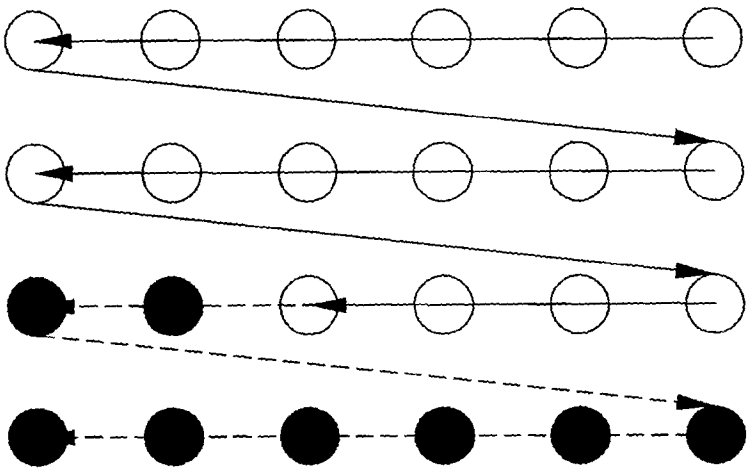
Figure 5A:
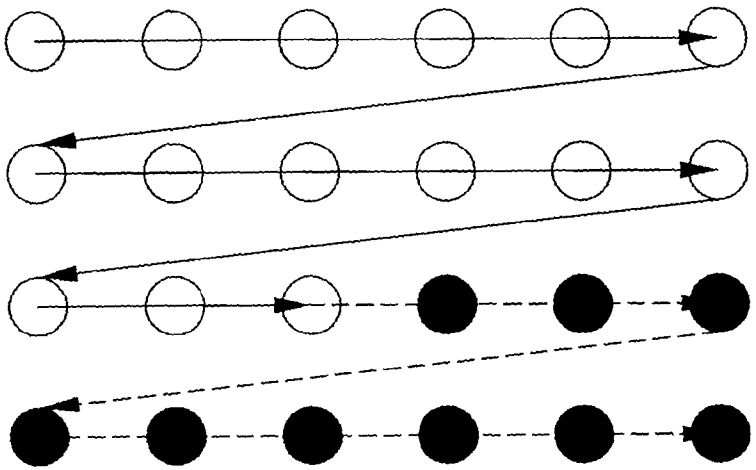
Figure 6B:
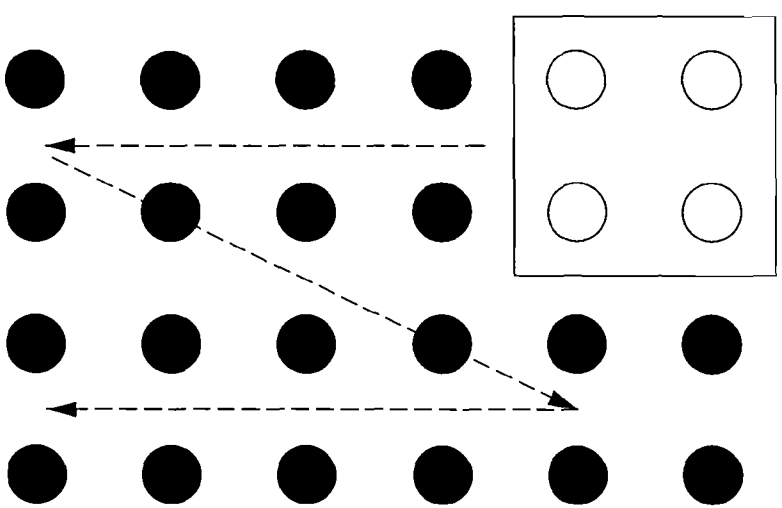
Figure 6A:
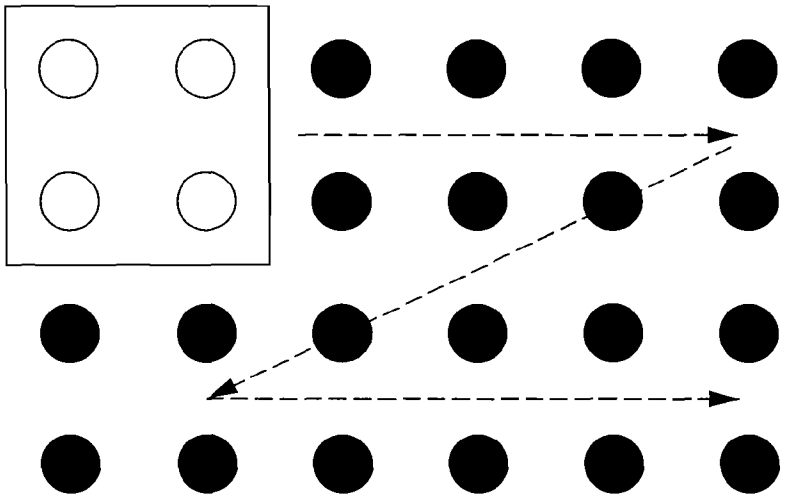
Figure 7B:
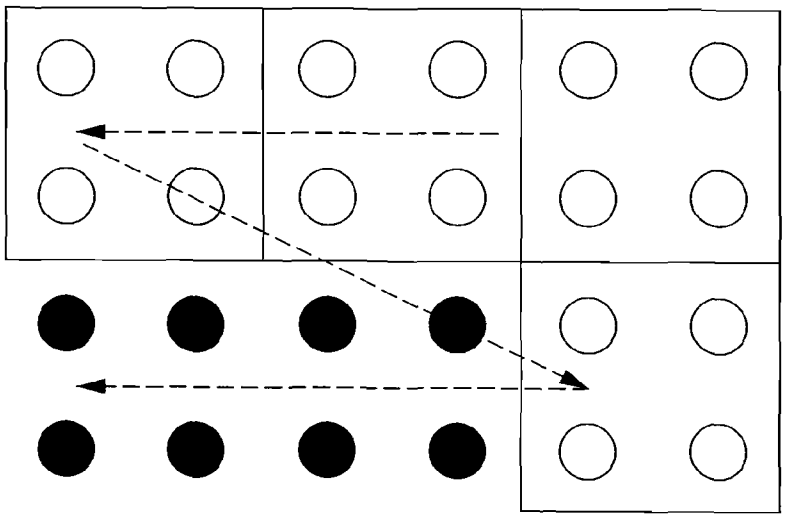
Figure 7A:
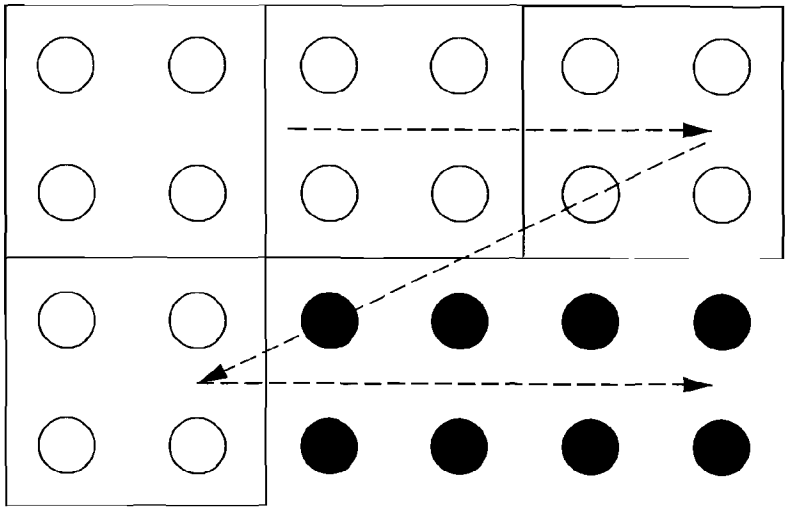
Figure 8A:
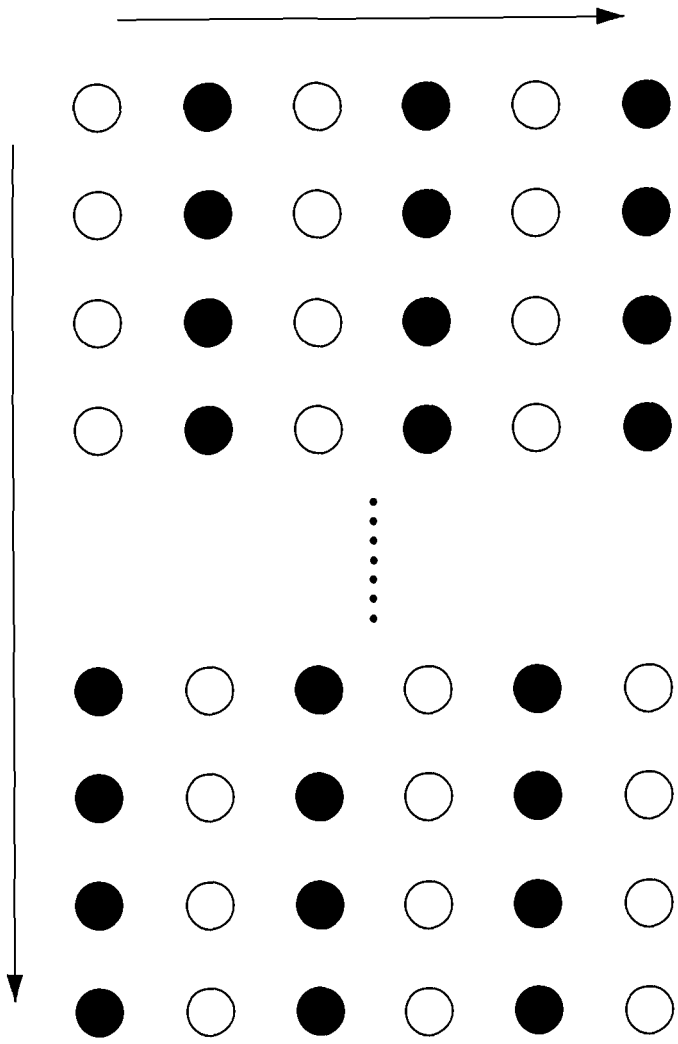
Figure 8B:
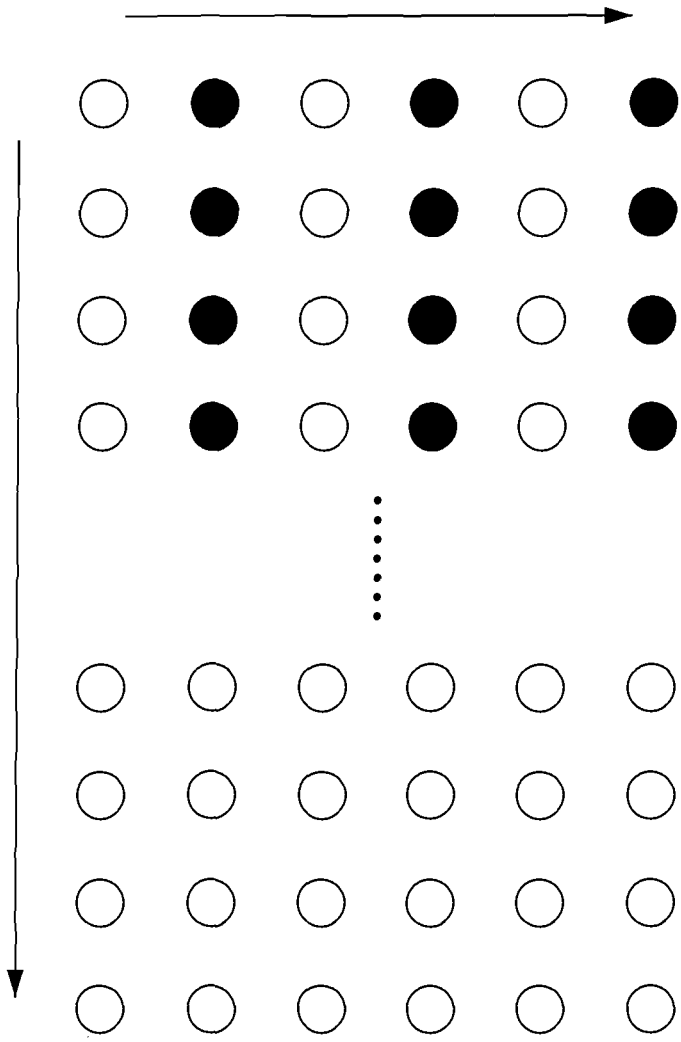
Figure 9A:
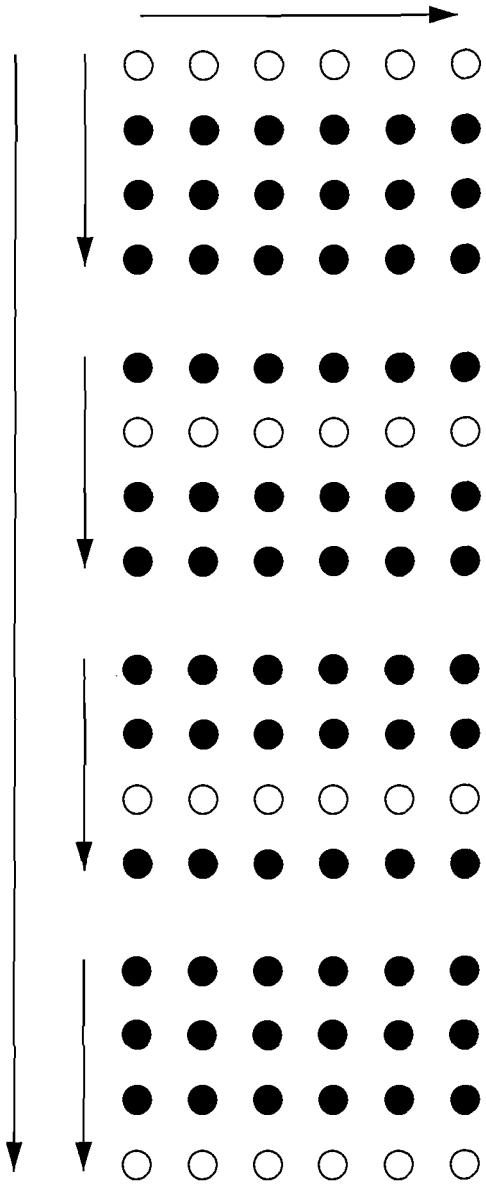
Figure 9B:
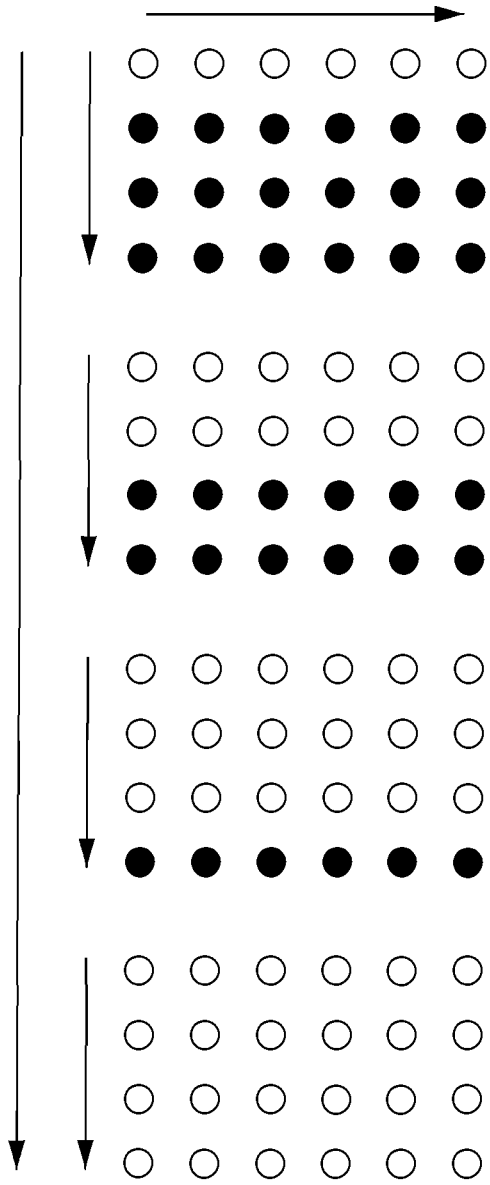
Figure 10A:
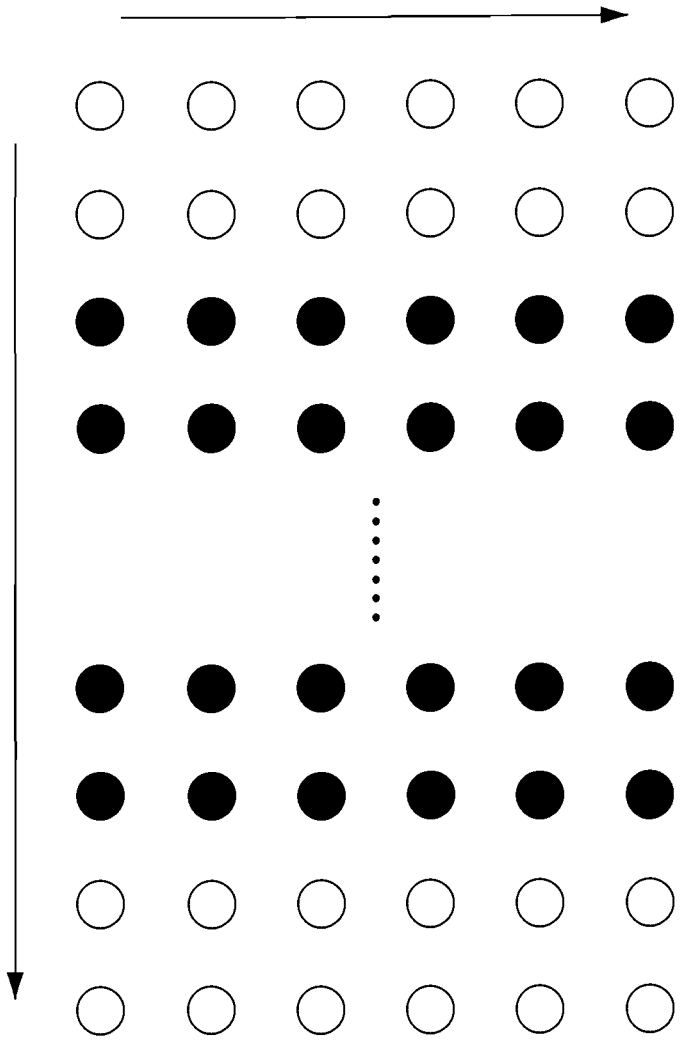
Figure 10B:
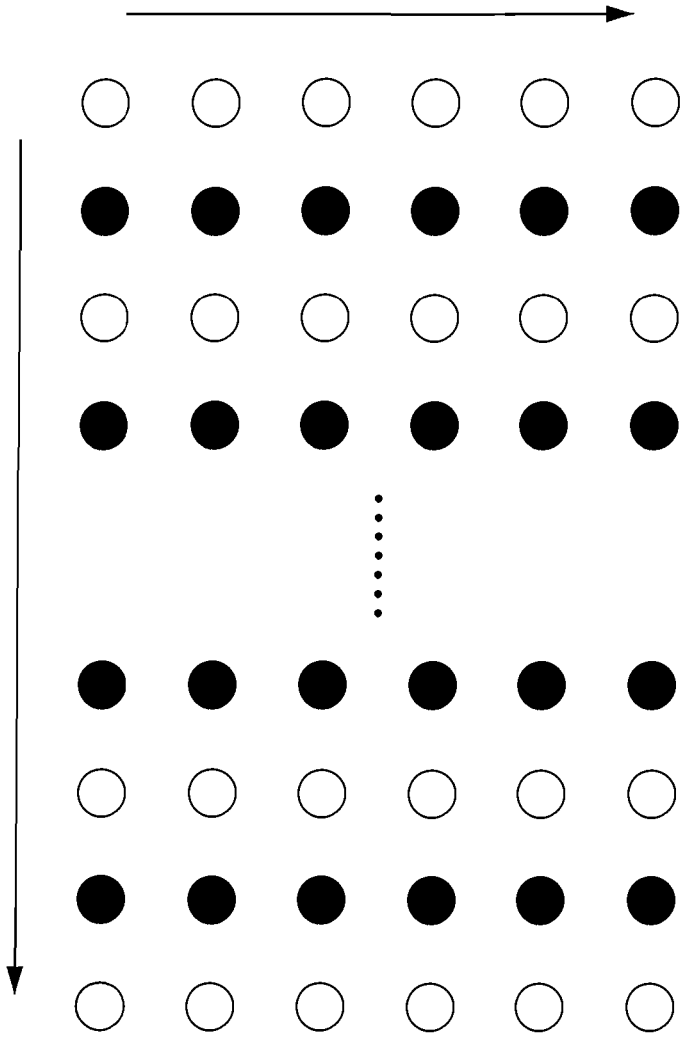
Figure 11A:
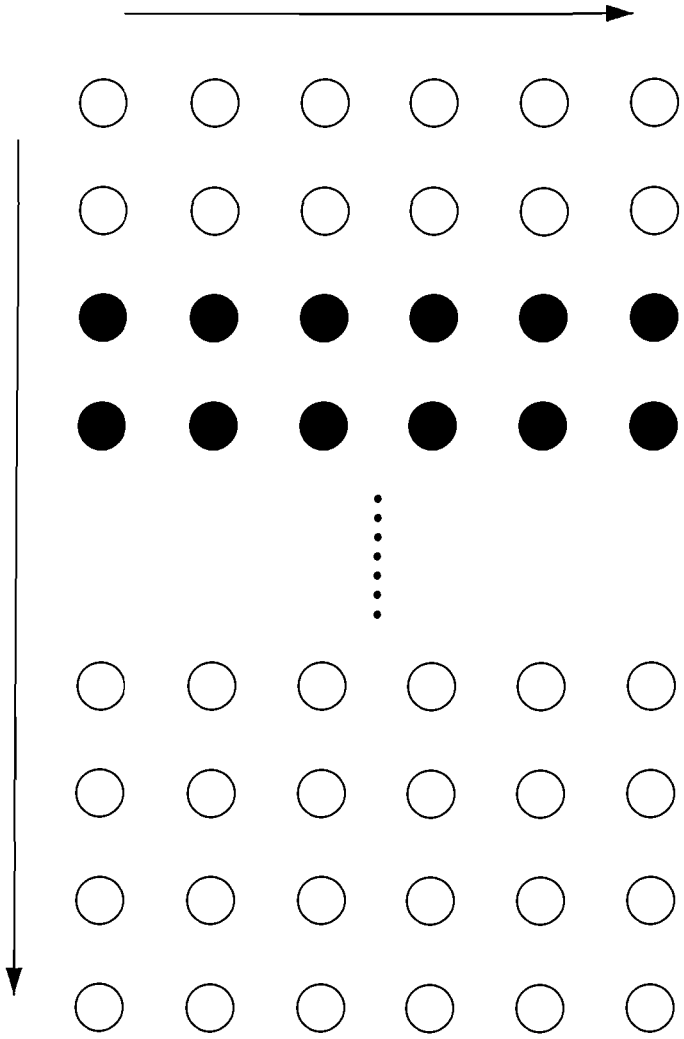
Figure 11B:
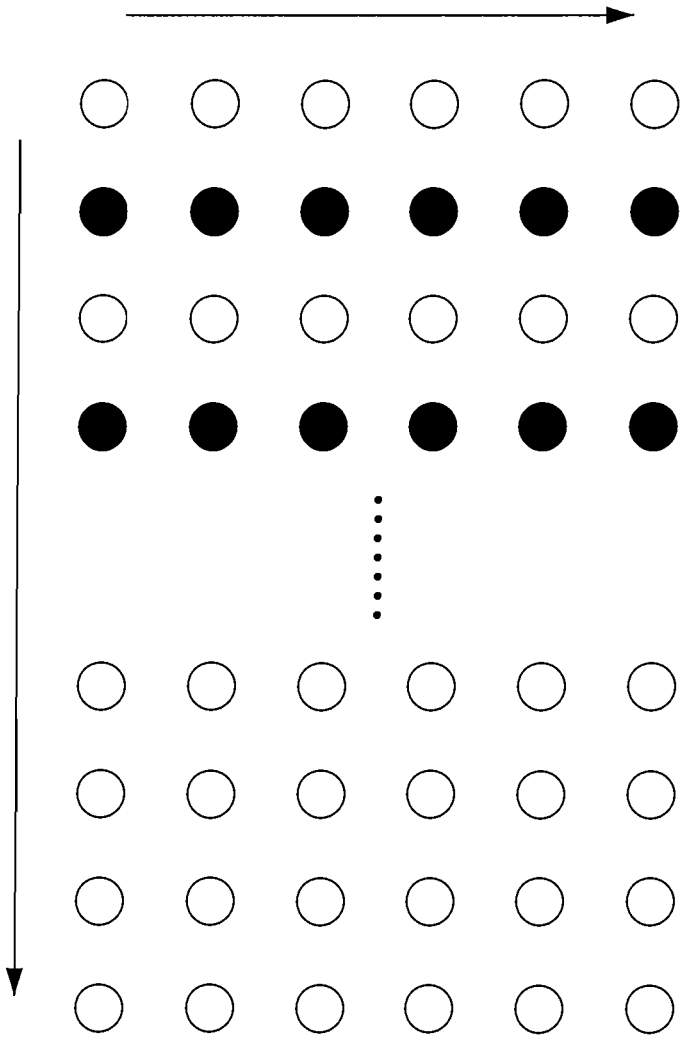

Besides, the above-mentioned blinking backlight module can achieve the purpose of independently modulate each of the plurality of light spots of the matrix type backlight source according to a specific order through the control of the driving system. FIGS. 4(*a*) and 4(*b*) show the driving method of the matrix type backlight source where a single light spot starts up one by one along a zigzag way, in which at one frame time point, only one spot of the matrix type backlight source is lit. That is, when the Nth spot is started up, the (N−1)th spot lit by the previous frame will be shut off. FIGS. 5(*a*) and 5(*b*) show that when the Nth light spot is started up, the (N−1)th spot lit in the previous frame remains lit. Beside the above-mentioned two embodiments, FIGS. 6(*a*)-7(*b*) show the embodiments where the number and initial starting up location of the light spot started up by each frame can be changed. Besides, in the embodiments of FIGS. 8(*a*)-9(*b*), the driving method has been changed into a row by row way or a column by column way, in which FIGS. 8(*a*) and 9(*a*) show that when the frame is converted, the light spot in the row and column that is previously started up will be shut off, while the embodiments of FIGS. 8(*b*) and 9(*b*) show that the light spot lit in the previous frame remains lit. The embodiments of FIGS. 10(*a*) and 10(*b*) show that plural rows (or plural columns) of light spots are started up at a time. The plural rows (or plural columns) of light spots can be chosen to be in proximity or not. The embodiments of FIGS. 11(*a*) and 11(*b*) have the same driving method as those of FIGS. 10(*a*) and 10(*b*), where only the previously started up light spots are not shut off when the frame is converted.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims, which are to be accorded with the broadest interpretation so as to encompass all such modifications and similar structures.

What is claimed is:

1. A driving system for a matrix type backlight module having a plurality of light spots, comprising:

a timing controller providing a timing signal to control a starting up sequence and a turning on time for each of the plurality of light spots;

a first storage device electrically connected to the timing controller, recording a driving power data of the plurality of light spots in a previous frame, providing an initial value for the driving power data for the plurality of light spots, wherein the first storage device is a repeatable access storage device, and a driving power data of the plurality of light spots in a next frame is determined by that in the previous frame;

a second storage device electrically connected to the timing controller and including a look up table (LUT) recording a data of a relationship between a driving power change from the previous frame to the next frame and the output brightness of each of the plurality of light spots during switching from the previous frame to the next frame;

a row driver electrically connected to the timing controller and providing a turning on time of the matrix type backlight module in a row direction according to the timing signal; and a column driver electrically connected to the timing controller and providing a turning on time of the matrix type backlight module in a column direction according to the timing signal;

wherein the time controller further determines an output brightness of each of the light spots according to the initial value of the driving power data from the first storage device and the driving power change from the LUT of the second storage device.

2. The driving system according to claim 1 being integrated in a panel board driving system of an active matrix thin film transistor (TFT) display.

3. The driving system according to claim 2 being used to synchronously drive the plurality of light spots and corresponding TFT pixels of the matrix type backlight module.

4. A blinking backlight module, comprising:

a matrix type backlight source, comprising a plurality of independent illuminating units to form a plurality of light spots of the blinking backlight module;

a driving system controlling a starting up sequence and a turning on time of each of the plurality of light spots of the blinking backlight module, and further comprising:

a timing controller providing a timing signal to control a starting up sequence and a turning on time of each of the plurality of light spots;

a row driver electrically connected with the timing controller and providing a turning on time of the matrix type backlight source in a row direction according to the timing signal; and a column driver electrically connected to the timing controller and providing a turning on time of the matrix type backlight source in a column direction according to the timing signal;

a first storage device electrically connected to the timing controller, recording a driving power data of the plurality of light spots in a previous frame, providing an initial value for the driving power data for the plurality of light spots, and providing a power signal to the timing controller to determine an output brightness of each of the plurality of light spots, wherein the first storage device is a repeatable access storage device, and a driving power data of the plurality of light spots in a next frame is determined by that in the previous frame; and a second storage device electrically connected to the timing controller and including a look up table (LUT) recording a data of a relationship between a driving power change from the previous frame to the next frame and the output brightness of each of the plurality of light spots during switching from the previous frame to the next frame, wherein the output brightness of each of the plurality of light spots is determined based on the initial value of the driving power data from the first storage device and the driving power change recorded in the LUT.

5. The blinking backlight module according to claim 4 being integrated in an active matrix thin film transistor (TFT) display.

6. The blinking backlight module according to claim 4, wherein the driving system is used to synchronously drive each of the plural light spots and corresponding TFT pixels of the matrix type backlight source.

7. A driving method of a matrix type backlight module having a plurality of light spots, a row driver and a column driver, comprising steps of:

providing a timing signal to control a starting up sequence and a turning on time of each of the plurality of light spots of the matrix type backlight module;

recording a driving power data of the plurality of light spots in a previous frame;

providing an initial value for the driving power data for the plurality of light spots;

determining a driving power data of the plurality of light spots in a next frame based on that in the previous frame;

recording a data of a relationship between a driving power change from the previous frame to the next frame and an output brightness of each of the plurality of light spots in a look up table (LUT) during switching from the previous frame to the next frame;

providing a power signal to determine the output brightness of each of the plurality of light spots according to the initial value of the driving power data and the driving power change in the LUT;

transmitting the timing signal to the row driver and the column driver; and determining a respective driving power for each of the plurality of light spots according to the timing signal and the power signal.

8. The method according to claim 7, wherein the timing signal controls the row driver and the column driver to start up each of the plurality of light spots of the matrix type backlight module according to a specific sequence.

9. The method according to claim 8, wherein the specific sequence is a sequence of scanning the plurality of light spots one by one.

10. The method according to claim 9, wherein the sequence of scanning is performed one by one along a zigzag way.

11. The method according to claim 8, wherein the specific sequence is a scanning sequence performed column by column for the plurality of light spots.

12. The method according to claim 8, wherein the specific sequence is a scanning sequence performed row by row for the plurality of light spots.

13. A driving system for a backlight module having a plurality of light spots, comprising:

a timing controller providing a timing signal;

a first storage device electrically connected to the timing controller, recording a driving power data of the plurality of light spots in a previous frame, providing an initial value for the driving power data for the plurality of light spots, wherein the first storage device is a repeatable access storage device, and a driving power data of the plurality of light spots in a next frame is determined by that in the previous frame;

a second storage device electrically connected to the timing controller and including a look up table (LUT) recording a data of a relationship between a driving power change from the previous frame to the next frame and the output brightness of each of the plurality of light spots during switching from the previous frame to the next frame; and a plurality of drivers electrically connected to the timing controller and providing a starting up sequence and a turning on time for each of the plurality of light spots according to the timing signal;

wherein the time controller further determines an output brightness of each of the light spots according to the initial value of the driving power data from the first storage device and the driving power change from the LUT of the second storage device.

14. The driving system according to claim 1, further comprising:

a thin film transistor (TFT) row driver electrically connected to the timing controller; and a TFT column driver electrically connected to the timing controller.

15. The blinking backlight module according to claim 4, further comprising:

a thin film transistor (TFT) row driver electrically connected to the timing controller; and a TFT column driver electrically connected to the timing controller.

16. The method according to claim 7, further comprising:

integrating the row driver and the column driver into a driver of a thin film transistor (TFT) panel.

17. The method according to claim 7, further comprising:

Providing a respective power signal for each of the plurality of light spots to the row driver, the column driver and a driver of a thin film transistor (TFT) panel based on the driving power data.

18. The driving system according to claim 13, further comprising:

a thin film transistor (TFT) row driver electrically connected to the timing controller; and a TFT column driver electrically connected to the timing controller.

* * * * *